US008671976B2

(12) United States Patent
Park et al.

(10) Patent No.: US 8,671,976 B2
(45) Date of Patent: Mar. 18, 2014

(54) EXHAUST CHECK VALVE OF SWASH PLATE COMPRESSOR

(75) Inventors: Jae Seok Park, Gyeongsangnam-do (KR); Ki Beom Kim, Anseong-si (KR); Geon Ho Lee, Seongnam-si (KR)

(73) Assignees: Doowon Technical College (KR); Doowon Electronic Co., Ltd. (KR)

( * ) Notice: Subject to any disclaimer, the term of this patent is extended or adjusted under 35 U.S.C. 154(b) by 543 days.

(21) Appl. No.: 13/057,752

(22) PCT Filed: Jul. 31, 2009

(86) PCT No.: PCT/KR2009/004316

§ 371 (c)(1),
(2), (4) Date: Feb. 4, 2011

(87) PCT Pub. No.: WO2010/018944

PCT Pub. Date: Feb. 18, 2010

(65) Prior Publication Data

US 2011/0139273 A1 Jun. 16, 2011

(30) Foreign Application Priority Data

Aug. 13, 2008 (KR) ..... 10-2008-0079347

(51) Int. Cl.
*F16K 15/02* (2006.01)
*F04B 39/10* (2006.01)

(52) U.S. Cl.
USPC ..... 137/543.19; 417/222.2

(58) Field of Classification Search
USPC ..... 137/543.19; 417/222.2
See application file for complete search history.

(56) References Cited

U.S. PATENT DOCUMENTS

| | | | | | |
|---|---|---|---|---|---|
| 5,010,916 | A * | 4/1991 | Albrecht | 137/543.19 |
| 5,112,198 | A * | 5/1992 | Skinner | 417/222.2 |
| 5,348,046 | A * | 9/1994 | Kozumplik et al. | 137/543.19 |
| 5,577,894 | A * | 11/1996 | Kawaguchi et al. | 417/222.2 |
| 5,871,337 | A * | 2/1999 | Fukanuma et al. | 417/222.2 |
| 6,019,125 | A * | 2/2000 | Reverberi | 137/543.19 |
| 6,149,397 | A * | 11/2000 | Mizutani et al. | 417/222.2 |
| 6,435,848 | B1 * | 8/2002 | Minami et al. | 417/222.2 |
| 6,511,297 | B2 * | 1/2003 | Ota et al. | 417/222.2 |
| 7,204,098 | B2 * | 4/2007 | Yamada et al. | 417/222.2 |

FOREIGN PATENT DOCUMENTS

| | | | |
|---|---|---|---|
| JP | 2001-153042 | A | 6/2001 |
| JP | 2002-013474 | A | 1/2002 |
| JP | 2005-337044 | A | 12/2005 |
| JP | 2007-298006 | A | 11/2007 |
| JP | 2008-121514 | A | 5/2008 |

OTHER PUBLICATIONS

International Search Report dated Feb. 5, 2010, for International Application No. PCT/KR2009/004316 (2 pages).

* cited by examiner

*Primary Examiner* — John Rivell
(74) *Attorney, Agent, or Firm* — Knobbe Martens Olson & Bear LLP

(57) ABSTRACT

An exhaust check valve installed in an exhaust opening of a swash plate compressor comprises: a valve body having a refrigerant inlet and at least one refrigerant outlet; a movable body installed in the valve body and configured to move such that the refrigerant inlet and the refrigerant outlet communicate with each other; and a spring configured to push the movable body with a certain pressure. At least one refrigerant vent hole for venting a leak gas generated during an operation below a preset pressure difference to the outside of the valve body is formed in the valve body.

13 Claims, 4 Drawing Sheets

EXHAUST CHECK VALVE OF SWASH PLATE COMPRESSOR

TECHNICAL FIELD

The present invention relates to an exhaust valve of a swash plate compressor, and more particularly to an exhaust check valve that is smoothly opened depending on a preset pressure difference, improving the reliability of the compressor.

BACKGROUND ART

In general, swash plate compressors are widely used in air conditioning systems for vehicles, and include a piston, a piston driving unit, a cylinder block, and a valve in common.

In such a swash plate compressor, a swash plate whose inclination angle is varied within a crank chamber rotates as its shaft rotates and a piston reciprocates to perform a compressing operation while the swash plate is rotating.

In this case, a refrigerant in a suction chamber is suctioned into a cylinder and is discharged to an exhaust chamber by reciprocal movement of the piston, in which case the inclination angle of the swash plate is varied to control the amount of exhausted refrigerant according to a difference between a pressure within the crank chamber and a pressure within the suction chamber.

As a result, the swash plate compressor suctions the refrigerant from the suction chamber and compresses the refrigerant by means of the piston, and the compressed refrigerant is exhausted to the exhaust chamber to repeat a cooling cycle.

Then, an exhaust check valve for exhausting the compressed refrigerant at a certain pressure and preventing the exhausted gas from reversely flowing to the compressor is installed in an exhaust opening communicated with the exhaust chamber.

In a clutch-less compressor, the exhaust check valve is maintained in a closed state when the compressor is operated below a preset pressure difference (when an air conditioner is switched off or the swash plate is operated with it being inclined by an angle below a certain value) and is opened only when the pressure difference is above a preset pressure difference.

However, in the conventional technology, a small amount of leak gas is generated in a fine gap between a movable member (valve) and a valve body (valve seat) when a compressor is driven below a preset pressure difference and the leak gas passes though the valve body to flow the rear surface of the movable member, making it difficult for the valve to be opened at the predetermined pressure due to a load of a spring on the rear surface of the movable member and a pressure of the leak gas.

DISCLOSURE

Technical Problem

Therefore, it is an object of the present invention to provide an exhaust check valve of a swash plate compressor that is normally opened according to an initially set pressure difference such that a leak gas generated during an operation of the compressor below a preset pressure difference is discharged through an exhaust pipe outside a valve body without being undesirably left.

Technical Solution

In order to achieve the above-mentioned objects, there is provided an exhaust check valve installed in an exhaust opening of a swash plate compressor, comprising: a valve body having a refrigerant inlet and at least one refrigerant outlet; a movable body installed in the valve body and configured to move such that the refrigerant inlet and the refrigerant outlet communicate with each other; and a spring configured to push the movable body with a certain pressure, wherein at least one refrigerant vent hole for venting a leak gas generated during an operation below a preset pressure difference to the outside of the valve body is formed in the valve body.

Preferably, the refrigerant vent hole is formed separately and independently from the refrigerant outlet.

Preferably, the refrigerant vent hole is formed so as to be continuous with the refrigerant outlet.

Preferably, the refrigerant vent hole is formed downstream of the refrigerant outlet with respect to a flow direction of the refrigerant.

Preferably, a plurality of refrigerant outlets and a plurality of refrigerant vent holes are alternately formed in the valve body along a circumferential direction of the valve body.

Preferably, the refrigerant vent hole and the refrigerant outlet are located on a same line along a moving direction of the movable body.

Preferably, a line passing through a center of the refrigerant vent hole and extending in a lengthwise direction of the valve body is spaced apart by a certain distance from a line passing through a center of the refrigerant outlet and extending in a lengthwise direction of the valve body.

Preferably, the refrigerant outlet and the refrigerant vent hole have different shapes.

Preferably, a top point of the refrigerant outlet in a lengthwise direction of the valve body is higher than a bottom point of the refrigerant vent hole in the lengthwise direction of the valve body.

Preferably, the valve body has a small diameter portion and a large diameter portion formed along a moving direction of the movable body and a stepped portion configured to limit movement of the movable body is formed between the small diameter portion and the large diameter portion.

Preferably, one end of the large diameter portion is opened such that a finishing member is coupled to the opened space and the spring is interposed between the finishing member and the movable member.

MODE FOR INVENTION

Hereinafter, exemplary embodiments of the present invention will be described in detail with reference to the accompanying drawings.

First, a variable displacement swash plate compressor 1000 will be described as a swash plate compressor having an exhaust check valve 100 according to the present invention.

Figure 1:
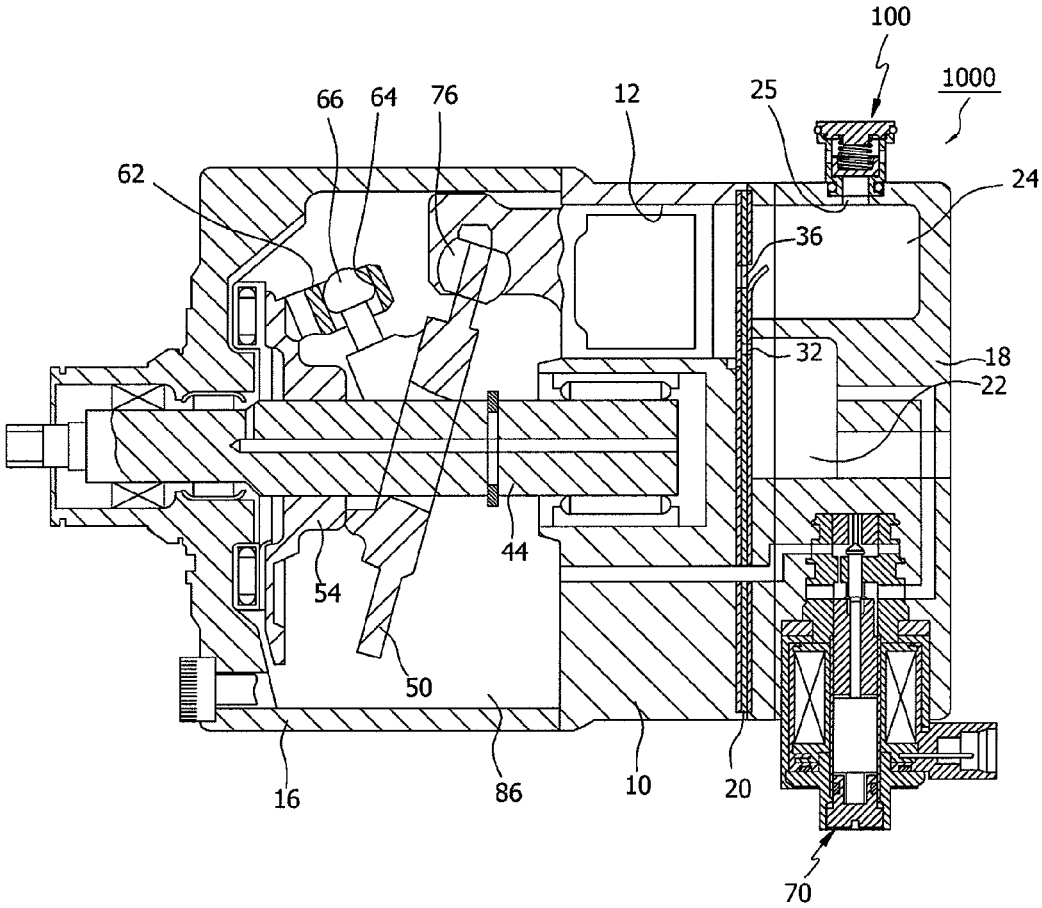
FIG. 1 is a sectional view illustrating a swash plate compressor according to an embodiment of the present invention.
Figure 2:
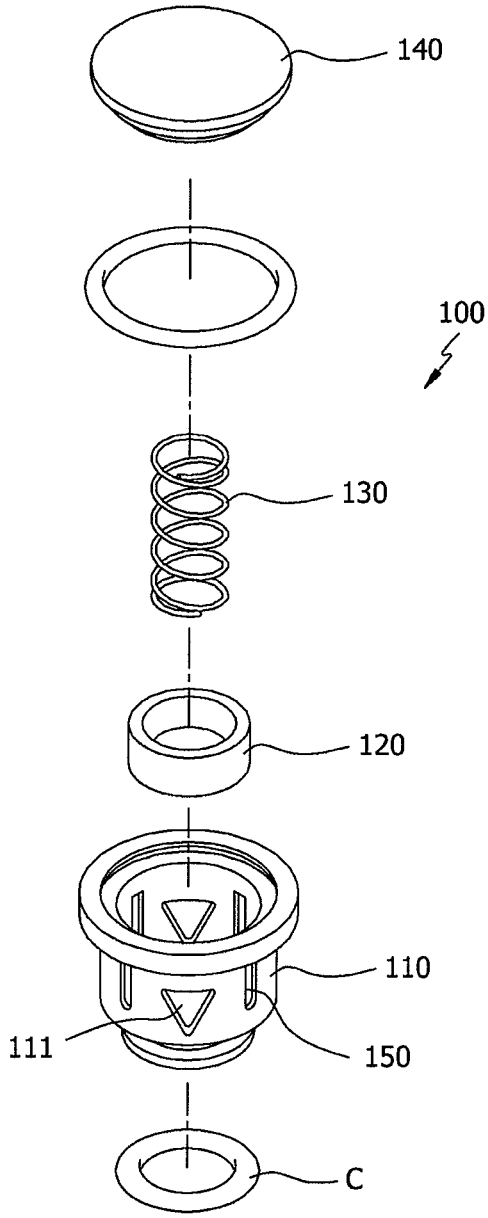
FIG. 2 is an exploded perspective view illustrating an exhaust check valve of FIG. 1.
Figure 3:
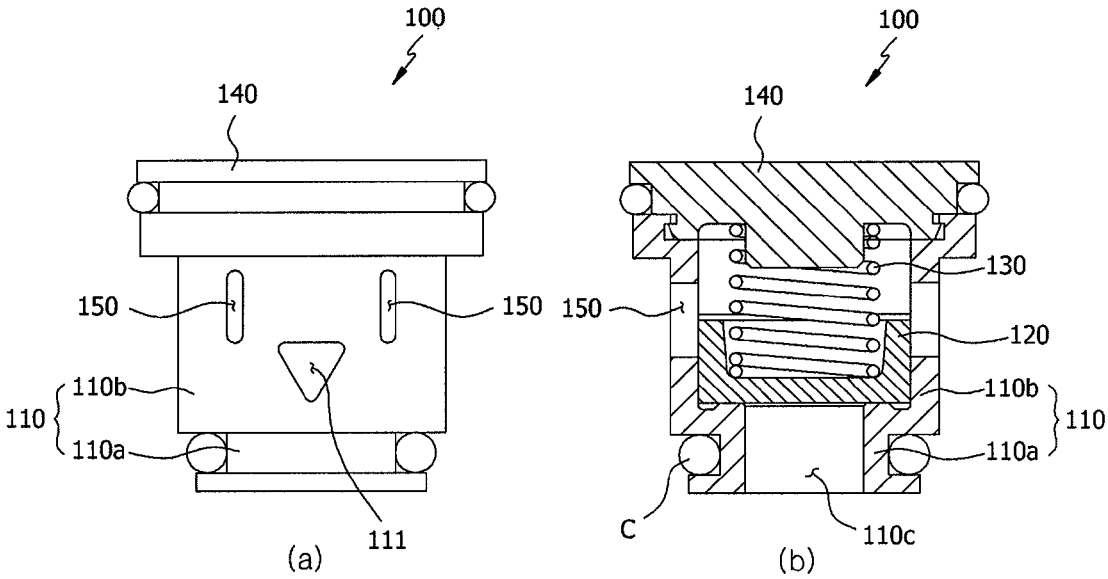
FIG. 3 illustrates a front view and a sectional view illustrating the exhaust check valve of FIG. 1.

As illustrated in FIG. 1, the variable displacement swash plate compressor 1000 includes a cylinder block 10 having a plurality of cylinder bores 12 formed in parallel to each other along a lengthwise direction thereof, a front housing 16 sealingly coupled to the front side of the cylinder block 10, and a rear housing 18 sealingly coupled to the rear side of the cylinder block 10 with a valve plate 20 being interposed therebetween.

A crank chamber 86 is provided within the front housing 16, and an end of a drive shaft 44 is rotatably supported in the vicinity of the center of the front housing 16 and an opposite end of the drive shaft 44 passes though the crank chamber 86 to be supported by a bearing installed in the cylinder block 10.

A lug plate 54 and a swash plate 50 are installed around the drive shaft 44 within the crank chamber 86.

A pair of power transmitting support arms 62 each having a linearly punched guide hole 64 protrudes on one surface of the lug plate 54 and a ball 66 is formed on one surface of the swash plate 50 such that the ball 66 of the swash plate 50 slides within the guide hole 64 of the lug plate 54 with an inclination angle of the swash plate 50 being varied as the lug plate 54 rotates.

A shoe 76 is provided on an outer side surfaces of the swash plate 50 such that the side surfaces are slidably inserted into each piston 14.

Thus, as the swash plate 50 rotates with it being inclined, the pistons 14 inserted into the outer side surfaces of the swash plate 50 with the shoe 76 being interposed between them reciprocates within the cylinder bores 12 of the cylinder block 10.

A suction chamber 22 and an exhaust chamber 24 are formed in the rear housing 18 and a suction valve 32 and an exhaust valve 36 are formed at portions of the valve plate interposed between the rear housing 18 and the cylinder block 10 which correspond to the cylinder bores 12.

The refrigerant in the suction chamber 22 is suctioned into the cylinder bores 12, and then is compressed and discharged to the exhaust chamber 24 during the reciprocal movement of the piston 14, in which case an inclination angle of the swash plate 50 according to a difference between a pressure of the crank chamber 86 and a pressure of a suction chamber 22 to control an amount of exhausted refrigerant such that a displacement control valve 70 for adjusting the pressure of the crank chamber 86 by opening and closing a valve through flow of currents and for controlling an exhaust capacity by adjusting the inclination angle of the swash plate 50.

In addition, an exhaust opening 25 communicated with the exhaust chamber 24 is formed in the rear housing 18, and an exhaust check valve 100 for exhausting the refrigerant compressed at a certain pressure difference above a predetermined value and preventing the exhausted gas from reversely flowing to the compressor.

Hereinafter, the exhaust check valve 100 of the present invention will be described in detail with reference to FIGS. 2 to 5.

The exhaust check valve 100 is adapted to repeatedly perform an operation of sending a refrigerant exhausted from the exhaust chamber 24 to the next cooling cycle, and generally includes a valve body 110, a movable member 120 installed in the valve body 110, and a spring 130 configured to pressure the movable member 120 with a certain pressure.

First, the valve body 110 has a small diameter portion 110*a* and a large diameter portion 110*b* communicated with each other along a lengthwise direction thereof, and a stepped portion 112 configured to limit movement of the below-described movable member 120 is formed between the small diameter portion 110*a* and the large diameter portion 110*b*.

A refrigerant inlet 110*c* through which the compressed refrigerant is introduced is formed at the center of the small diameter portion 110*a* and an O-ring c for sealing with the exhaust opening 25 is mounted on the circumference of the small diameter portion 110*a*.

In addition, the below-described movable member 120 and the spring 130 are installed within the large diameter portion 110*b* and a refrigerant outlet 111 through which the refrigerant introduced from the refrigerant inlet 110*c* is discharged is formed on the circumference of the large diameter portion 110*b*.

Here, although one end of the large diameter portion 110*b* is opened and a separate finishing member 140 is coupled to the opened space, the present invention is not limited thereto but the large diameter portion 110*b* and the finishing member 140 may be integrally formed by injection molding.

In particular, a refrigerant vent hole 150 is formed in the large diameter portion 110*b* such that a leak gas generated at a pressure difference below a preset value is naturally discharged to the outside (exhaust pipe) of the valve body 110.

That is, the refrigerant vent hole 150 is adapted to prevent the movable member 120 from being delayed in being opened by a back pressure of the leak gas left in the valve body 110 when an inclination angle of the swash plate of the compressor increases to above a predetermined value.

Thus, the below-described movable member 120 normally slides depending on an initially set opening/closing pressure difference.

It is preferable that the refrigerant vent hole 150 and the refrigerant outlet 111 are alternately formed at an interval along a circumferential direction of the valve body 110.

The refrigerant vent hole 150 is formed separately and independently from the refrigerant outlet 111, and a plurality of refrigerant outlets 111 and a plurality of refrigerant vent holes 150 are alternately formed in the valve body 110 along a circumferential direction of the valve body 110.

Preferably, the refrigerant vent hole 150 is formed downstream of the refrigerant outlet 111 with respect to a flow direction of the refrigerant.

Then, the refrigerant outlet 111 and the refrigerant vent hole 150 have different shapes.

Here, although the refrigerant vent hole 150 may be in the form of a slot hole, the present invention is not limited thereto but may have various shapes such as a polygon, a circle, and a heart.

Meanwhile, a top point of the refrigerant outlet 111 in a lengthwise direction of the valve body 110 is higher than a bottom point of the refrigerant vent hole 150 in the lengthwise direction of the valve body 110.

Moreover, a line passing through a center of the refrigerant vent hole 150 and extending in a lengthwise direction of the valve body 110 is spaced apart by a certain distance from a line passing through a center of the refrigerant outlet 111 and extending in a lengthwise direction of the valve body 110.

Figure 4:
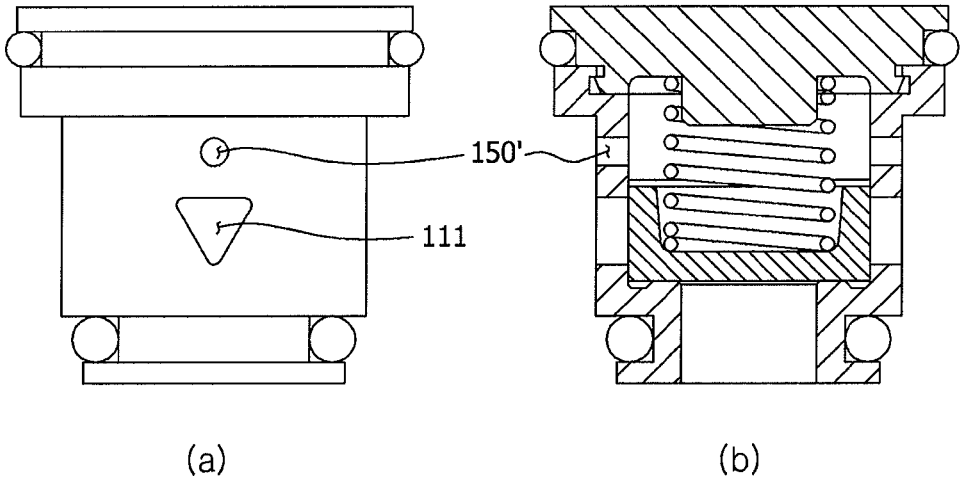
FIG. 4 illustrates a front view and a sectional view illustrating another embodiment of a refrigerant vent hole of the exhaust check valve of FIG. 3.

As illustrated in FIG. 4, the refrigerant vent hole 150' and the refrigerant outlet 111 may be arranged on the same line along a moving direction of the movable member 120 at an interval.

Figure 5:
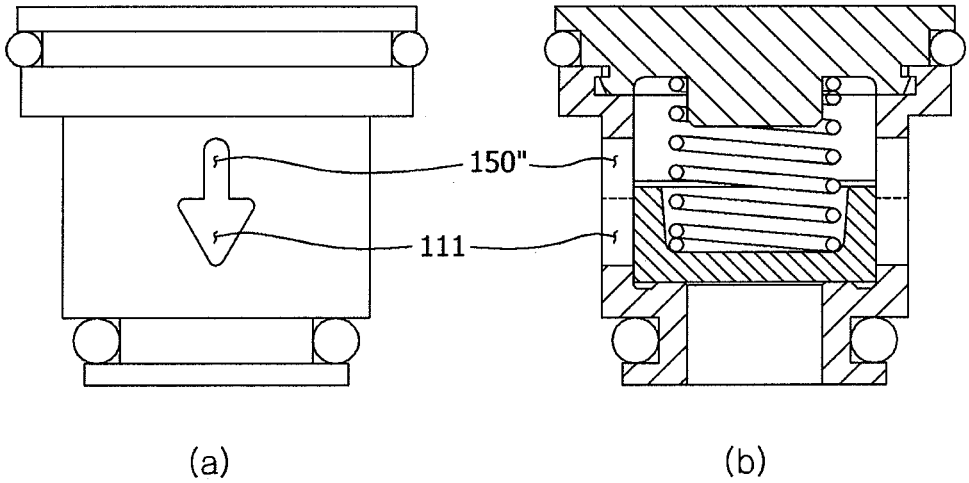
FIG. 5 illustrates a front view and a sectional view illustrating still another embodiment of a refrigerant vent hole of the exhaust check valve of FIG. 3.

Further, as illustrated in FIG. 5, the refrigerant vent hole 150" may be communicated with one end of the refrigerant outlet 111. That is, the refrigerant vent hole 150" is formed so as to be continuous with the refrigerant outlet 111.

Meanwhile, the movable member 120 can be slidably moved to open and close the refrigerant inlet 110*c* and the refrigerant outlet 111 together with it being corresponding to an inner diameter of the large diameter 110*b* of the valve body 110.

In more detail, the movable member 120 has a circular plate shape to close the refrigerant inlet 110*c* and the periphery of the circular plate shape is bent to extend by a certain height.

Moreover, one end of the spring 130 is inserted into and fixed to the finishing member 140, and an opposite end thereof pushes the movable member 120.

The spring 130 can adjust a pressure difference by which the movable member 120 is opened and closed depending on a resiliency thereof.

In the exhaust check valve 100 of a swash plate compressor according to the embodiment of the present invention, if a pressure of compressed refrigerant is higher than a pressure toward a condenser and a resilient force of the spring 130 in the process of operating an air conditioner, the movable member 120 is moved to discharge the refrigerant to the refrigerant outlet 111 of the valve body 110 at the same time. That is, the check valve 100 is opened by an exhaust pressure exceeding a preset pressure difference.

Thereafter, since when the air conditioner is switched off or the swash plate is driven at an inclination angle below a certain value, the pressure of the spring 130 is larger than a refrigerant pressure in the exhaust chamber, the refrigerant inlet 110*c* of the valve body 110 is closed by pushing the movable member 120.

Then, the interior of the valve body 110 is communicated with the outside through the refrigerant vent hole 150, the leak gas is discharged to the exhaust pipe through the refrigerant outlet 150 with a back pressure not being applied to the movable member 120.

Thus, if an inclination angle of the swash plate increases to above a predetermined value and a pressure difference due to an exhaust pressure exceeds a preset value due to driving of the air conditioner, the movable member 120 is moved to open the valve.

In this case, since a back pressure due to leak gas is not applied to the movable member 120 and only a resilient resistance force exists due to the spring 130, the valve is prevented from being delayed. As a result, in the exhaust check valve 100, the movable member 120 can be smoothly opened and closed according to an initially set pressure difference.

INDUSTRIAL AVAILABILITY

According to the present invention, since a refrigerant vent hole for venting leak gas generated during an operation below a preset pressure difference to the outside of a valve body is formed in an exhaust check valve, a refrigerant can be smoothly exhausted according to the set pressure difference, making it possible to improving the efficiency and reliability of a compressor at the same time.

The invention claimed is:

1. An exhaust check valve installed in an exhaust opening of a swash plate compressor, comprising:

a valve body having a refrigerant inlet and at least one refrigerant outlet;

a movable body installed in the valve body and configured to move such that the refrigerant inlet and the refrigerant outlet communicate with each other; and a spring configured to push the movable body with a certain pressure, wherein at least one refrigerant vent hole for venting leak gas generated during an operation below a preset pressure difference to the outside of the valve body is formed in the valve body, wherein the refrigerant vent hole is formed separately and independently from the refrigerant outlet, wherein the refrigerant outlet and the refrigerant vent hole have different shapes.

2. The exhaust check valve as claimed in claim 1, wherein the refrigerant vent hole is formed downstream of the refrigerant outlet with respect to a flow direction of the refrigerant.

3. The exhaust check valve as claimed in claim 1, wherein the valve body has a small diameter portion and a large diameter portion formed along a moving direction of the movable body and a stepped portion configured to limit movement of the movable body is formed between the small diameter portion and the large diameter portion.

4. The exhaust check valve as claimed in claim 3, wherein one end of the large diameter portion is opened such that a finishing member is coupled to the opened space and the spring is interposed between the finishing member and the movable member.

5. An exhaust check valve installed in an exhaust opening of a swash plate compressor, comprising:

a valve body having a refrigerant inlet and at least one refrigerant outlet;

a movable body installed in the valve body and configured to move such that the refrigerant inlet and the refrigerant outlet communicate with each other; and a spring configured to push the movable body with a certain pressure, wherein at least one refrigerant vent hole for venting a leak gas generated during an operation below a preset pressure difference to the outside of the valve body is formed in the valve body, wherein the refrigerant vent hole is formed so as to be continuous with the refrigerant outlet, wherein the refrigerant outlet and the refrigerant vent hole have different shapes.

6. The exhaust check valve as claimed in claim 5, wherein the refrigerant vent hole is formed downstream of the refrigerant outlet with respect to a flow direction of the refrigerant.

7. The exhaust check valve as claimed in claim 5, wherein the refrigerant vent hole and the refrigerant outlet are located on a same line along a moving direction of the movable body.

8. The exhaust check valve as claimed in claim 5, wherein the valve body has a small diameter portion and a large diameter portion formed along a moving direction of the movable body and a stepped portion configured to limit movement of the movable body is formed between the small diameter portion and the large diameter portion.

9. The exhaust check valve as claimed in claim 8, wherein one end of the large diameter portion is opened such that a finishing member is coupled to the opened space and the spring is interposed between the finishing member and the movable member.

10. An exhaust check valve installed in an exhaust opening of a swash plate compressor, comprising:

a valve body having a refrigerant inlet and a plurality of refrigerant outlets;

a movable body installed in the valve body and configured to move such that the refrigerant inlet and the plurality of refrigerant outlets communicate with each other; and a spring configured to push the movable body with a certain pressure, wherein a plurality of refrigerant vent holes for venting leak gas generated during an operation below a preset pressure difference to the outside of the valve body is formed in the valve body, wherein the plurality of refrigerant vent holes are formed separately and independently from the plurality of refrigerant outlets, wherein the plurality of refrigerant outlets and the plurality of refrigerant vent holes are alternately formed in the valve body along a circumferential direction of the valve body.

11. The exhaust check valve as claimed in claim 10, wherein a line passing through a center of the refrigerant vent hole and extending in a lengthwise direction of the valve body is spaced apart by a certain distance from a line passing through a center of the refrigerant outlet and extending in a lengthwise direction of the valve body.

12. An exhaust check valve installed in an exhaust opening of a swash plate compressor, comprising:

a valve body having a refrigerant inlet and at least one refrigerant outlet;

a movable body installed in the valve body and configured to move such that the refrigerant inlet and the refrigerant outlet communicate with each other; and a spring configured to push the movable body with a certain pressure, wherein at least one refrigerant vent hole for venting a leak gas generated during an operation below a preset pressure difference to the outside of the valve body is formed in the valve body, wherein the refrigerant vent hole is formed separately and independently from the refrigerant outlet, wherein the refrigerant vent hole and the refrigerant outlet are located on a same line along a moving direction of the movable body.

13. An exhaust check valve installed in an exhaust opening of a swash plate compressor, comprising:

a valve body having a refrigerant inlet and at least one refrigerant outlet;

a movable body installed in the valve body and configured to move such that the refrigerant inlet and the refrigerant outlet communicate with each other; and a spring configured to push the movable body with a certain pressure, wherein at least one refrigerant vent hole for venting a leak gas generated during an operation below a preset pressure difference to the outside of the valve body is formed in the valve body, wherein the refrigerant vent hole is formed separately and independently from the refrigerant outlet, wherein a top point of the refrigerant outlet in a lengthwise direction of the valve body is higher than a bottom point of the refrigerant vent hole in the lengthwise direction of the valve body.

* * * * *